US008893804B2

(12) United States Patent
Fripp et al.

(10) Patent No.: US 8,893,804 B2
(45) Date of Patent: Nov. 25, 2014

(54) ALTERNATING FLOW RESISTANCE INCREASES AND DECREASES FOR PROPAGATING PRESSURE PULSES IN A SUBTERRANEAN WELL

(75) Inventors: Michael L. Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 621 days.

(21) Appl. No.: 12/792,095

(22) Filed: Jun. 2, 2010

(65) Prior Publication Data

US 2011/0042092 A1 Feb. 24, 2011

Related U.S. Application Data

(63) Continuation-in-part of application No. 12/700,685, filed on Feb. 4, 2010, which is a continuation-in-part of application No. 12/542,695, filed on Aug. 18, 2009, now abandoned.

(51) Int. Cl.
*E21B 34/08* (2006.01)
*E21B 34/06* (2006.01)

(52) U.S. Cl.
CPC ..... *E21B 34/06* (2013.01); *E21B 34/08* (2013.01)
USPC ..... 166/373; 166/319; 137/808

(58) Field of Classification Search
USPC ..... 166/311, 319, 373; 137/806, 808, 812, 137/813, 826
See application file for complete search history.

(56) References Cited

U.S. PATENT DOCUMENTS

| | | | |
|---|---|---|---|
| 2,140,735 | A | 12/1938 | Clarke et al. |
| 2,324,819 | A | 6/1941 | Butzbach |
| 3,078,862 | A | 2/1963 | Maly |
| 3,091,393 | A | 5/1963 | Sparrow |
| 3,111,931 | A | 11/1963 | Bodine |
| 3,114,390 | A | 12/1963 | Glättli |
| 3,216,439 | A | 11/1965 | Manion |
| 3,233,621 | A | 2/1966 | Manion |
| 3,238,960 | A | 3/1966 | Hatch, Jr. |

(Continued)

FOREIGN PATENT DOCUMENTS

| | | | |
|---|---|---|---|
| EP | 0304988 | B1 | 11/1992 |
| EP | 0834342 | A2 | 4/1998 |

(Continued)

OTHER PUBLICATIONS

International Search Report with Written Opinion issued Jan. 5, 2012 for PCT Patent Application No. PCT/US2011/047925, 9 pages.

(Continued)

*Primary Examiner* — Robert E Fuller
(74) *Attorney, Agent, or Firm* — Smith IP Services, P.C.

(57) ABSTRACT

A method of propagating pressure pulses in a well can include flowing a fluid composition through a variable flow resistance system which includes a vortex chamber having at least one inlet and an outlet, a vortex being created when the fluid composition spirals about the outlet, and a resistance to flow of the fluid composition alternately increasing and decreasing. The vortex can be alternately created and dissipated in response to flowing the fluid composition through the system. A well system can include a variable flow resistance system which propagates pressure pulses into a formation in response to flow of a fluid composition from the formation.

15 Claims, 9 Drawing Sheets

(56) References Cited

U.S. PATENT DOCUMENTS 3,244,189 A 4/1966 Bailey
3,247,861 A 4/1966 Bauer
3,256,899 A 6/1966 Dexter et al.
3,282,279 A 11/1966 Manion
3,343,790 A 9/1967 Bowles
3,397,713 A 8/1968 Warren
3,407,828 A 10/1968 Jones
3,461,897 A 8/1969 Kwok
3,470,894 A 10/1969 Rimmer
3,474,670 A 10/1969 Rupert
3,489,009 A 1/1970 Rimmer
3,515,160 A 6/1970 Cohen
3,529,614 A 9/1970 Nelson
3,537,466 A 11/1970 Chapin
3,566,900 A 3/1971 Black
3,586,104 A 6/1971 Hyde
3,598,137 A 8/1971 Glaze
3,620,238 A 11/1971 Kawabata et al.
3,670,753 A 6/1972 Healey
3,704,832 A 12/1972 Fix et al.
3,712,321 A 1/1973 Bauer
3,717,164 A 2/1973 Griffin
3,754,576 A 8/1973 Zetterstrom et al.
3,776,460 A 12/1973 Fichter
3,842,907 A 10/1974 Baker et al.
3,885,627 A 5/1975 Berry et al.
3,885,931 A 5/1975 Schaller
3,942,557 A 3/1976 Tsuchiya
4,029,127 A 6/1977 Thompson
4,052,002 A 10/1977 Stouffer et al.
4,082,169 A 4/1978 Bowles
4,127,173 A * 11/1978 Watkins et al. ..... 166/276
4,151,955 A 5/1979 Stouffer
4,167,873 A 9/1979 Bahrton
4,187,909 A 2/1980 Erbstoesser
4,276,943 A 7/1981 Holmes
4,286,627 A 9/1981 Graf
4,291,395 A 9/1981 Holmes
4,307,653 A 12/1981 Goes et al.
4,323,991 A 4/1982 Holmes et al.
4,385,875 A 5/1983 Kanazawa
4,390,062 A 6/1983 Fox
4,418,721 A 12/1983 Holmes
4,518,013 A 5/1985 Lazarus
4,550,614 A 11/1985 Herzl
4,557,295 A 12/1985 Holmes
4,838,091 A 6/1989 Markland et al.
4,846,224 A 7/1989 Collins, Jr. et al.
4,895,582 A 1/1990 Bielefeldt
4,919,204 A 4/1990 Baker et al.
4,969,827 A 11/1990 Hahs, Jr.
4,976,155 A 12/1990 Challandes
5,052,442 A 10/1991 Johannessen
5,063,786 A 11/1991 Sanderson et al.
5,127,173 A 7/1992 Thurston et al.
5,165,450 A 11/1992 Marrelli
5,184,678 A 2/1993 Pechkov et al.
5,228,508 A 7/1993 Facteau et al.
5,303,782 A 4/1994 Johannessen
5,339,695 A 8/1994 Kang et al.
5,455,804 A 10/1995 Holmes et al.
5,482,117 A 1/1996 Kolpak et al.
5,484,016 A 1/1996 Surjaatmadja et al.
5,505,262 A * 4/1996 Cobb ..... 166/312
5,533,571 A 7/1996 Surjaatmadja et al.
5,570,744 A 11/1996 Weingarten et al.
5,827,976 A 10/1998 Stouffer et al.
5,893,383 A * 4/1999 Facteau ..... 137/14
5,919,327 A 7/1999 Smith
5,947,183 A 9/1999 Schneider et al.
6,015,011 A 1/2000 Hunter
6,112,817 A 9/2000 Voll et al.
6,241,019 B1 6/2001 Davidson et al.
6,336,502 B1 1/2002 Surjaatmadja et al.
6,345,963 B1 2/2002 Thomin et al.
6,367,547 B1 4/2002 Towers et al.
6,371,210 B1 4/2002 Bode et al.
6,405,797 B2 6/2002 Davidson et al.
6,497,252 B1 12/2002 Kohler et al.
6,619,394 B2 9/2003 Soliman et al.
6,622,794 B2 9/2003 Zisk, Jr.
6,627,081 B1 9/2003 Hilditch et al.
6,644,412 B2 11/2003 Bode et al.
6,691,781 B2 2/2004 Grant et al.
6,719,048 B1 4/2004 Ramos et al.
6,851,473 B2 2/2005 Davidson
6,913,079 B2 * 7/2005 Tubel ..... 166/250.01
6,976,507 B1 12/2005 Webb et al.
7,025,134 B2 4/2006 Byrd et al.
7,114,560 B2 10/2006 Nguyen et al.
7,185,706 B2 3/2007 Freyer
7,213,650 B2 5/2007 Lehman et al.
7,213,681 B2 5/2007 Birchak et al.
7,216,738 B2 5/2007 Birchak et al.
7,290,606 B2 11/2007 Coronado et al.
7,318,471 B2 1/2008 Rodney et al.
7,404,416 B2 7/2008 Schultz et al.
7,405,998 B2 7/2008 Webb et al.
7,409,999 B2 8/2008 Henriksen et al.
7,413,010 B2 8/2008 Blauch et al.
7,537,056 B2 5/2009 MacDougall
7,578,343 B2 8/2009 Augustine
7,621,336 B2 11/2009 Badalamenti et al.
7,828,067 B2 11/2010 Scott et al.
7,857,050 B2 12/2010 Zazovsky et al.
8,127,856 B1 3/2012 Nish et al.
8,235,128 B2 8/2012 Dykstra et al.
8,261,839 B2 9/2012 Fripp et al.
8,276,669 B2 10/2012 Dykstra et al.
8,327,885 B2 12/2012 Dykstra et al.
8,356,668 B2 1/2013 Dykstra et al.
8,376,047 B2 2/2013 Dykstra et al.
8,381,817 B2 2/2013 Schultz et al.
8,418,725 B2 4/2013 Schultz et al.
8,430,130 B2 4/2013 Dykstra
8,439,117 B2 5/2013 Schultz et al.
8,453,745 B2 6/2013 Schultz et al.
8,464,759 B2 6/2013 Dykstra et al.
8,479,831 B2 7/2013 Dykstra et al.
8,517,105 B2 8/2013 Schultz et al.
8,517,106 B2 8/2013 Schultz et al.
8,517,107 B2 8/2013 Schultz et al.
8,517,108 B2 8/2013 Schultz et al.
8,555,924 B2 10/2013 Faram et al.
8,555,975 B2 10/2013 Dykstra et al.
8,584,762 B2 11/2013 Fripp et al.
8,602,106 B2 12/2013 Lopez
8,657,017 B2 2/2014 Dykstra et al.
2004/0011733 A1 1/2004 Bjornsson
2005/0214147 A1 9/2005 Schultz et al.
2006/0104728 A1 5/2006 Erickson et al.
2006/0131033 A1 6/2006 Bode et al.
2007/0028977 A1 2/2007 Goulet
2007/0045038 A1 3/2007 Han et al.
2007/0246407 A1 10/2007 Richards et al.
2007/0256828 A1 11/2007 Birchak et al.
2008/0035350 A1 2/2008 Henriksen et al.
2008/0041580 A1 2/2008 Freyer et al.
2008/0041581 A1 2/2008 Richards
2008/0041582 A1 2/2008 Saetre et al.
2008/0041588 A1 2/2008 Richards et al.
2008/0041590 A1 2/2008 Badalamenti et al.
2008/0047718 A1 2/2008 Orr et al.
2008/0149323 A1 6/2008 O'Malley et al.
2008/0169099 A1 7/2008 Pensgaard
2008/0236839 A1 10/2008 Oddie
2008/0261295 A1 10/2008 Butler et al.
2008/0283238 A1 11/2008 Richards et al.
2008/0314590 A1 12/2008 Patel
2009/0000787 A1 1/2009 Hill et al.
2009/0008088 A1 1/2009 Schultz et al.
2009/0008090 A1 1/2009 Schultz et al.
2009/0009297 A1 1/2009 Shinohara et al.
2009/0009333 A1 1/2009 Bhogal et al.

(56) References Cited

U.S. PATENT DOCUMENTS

| | | | |
|---|---|---|---|
| 2009/0009336 | A1 | 1/2009 | Ishikawa |
| 2009/0009412 | A1 | 1/2009 | Warther |
| 2009/0009437 | A1 | 1/2009 | Hwang et al. |
| 2009/0009445 | A1 | 1/2009 | Lee |
| 2009/0009447 | A1 | 1/2009 | Naka et al. |
| 2009/0065197 | A1 | 3/2009 | Eslinger |
| 2009/0078427 | A1 | 3/2009 | Patel |
| 2009/0078428 | A1 | 3/2009 | Ali |
| 2009/0101352 | A1 | 4/2009 | Coronado et al. |
| 2009/0101354 | A1 | 4/2009 | Holmes et al. |
| 2009/0120647 | A1 | 5/2009 | Turick et al. |
| 2009/0133869 | A1 | 5/2009 | Clem |
| 2009/0151925 | A1 | 6/2009 | Richards et al. |
| 2009/0159282 | A1 | 6/2009 | Webb et al. |
| 2009/0178801 | A1 | 7/2009 | Nguyen et al. |
| 2009/0250224 | A1 | 10/2009 | Wright et al. |
| 2009/0277639 | A1 | 11/2009 | Schultz et al. |
| 2009/0277650 | A1 | 11/2009 | Casciaro et al. |
| 2011/0042091 | A1 | 2/2011 | Dykstra et al. |
| 2011/0042092 | A1 | 2/2011 | Fripp et al. |
| 2011/0079384 | A1 | 4/2011 | Russell et al. |
| 2011/0186300 | A1 | 8/2011 | Dykstra et al. |
| 2011/0198097 | A1 | 8/2011 | Moen |
| 2011/0214876 | A1 | 9/2011 | Dykstra et al. |
| 2011/0297384 | A1 | 12/2011 | Fripp et al. |
| 2011/0297385 | A1 | 12/2011 | Dykstra et al. |
| 2011/0308806 | A9 | 12/2011 | Dykstra et al. |
| 2012/0048563 | A1 | 3/2012 | Holderman |
| 2012/0060624 | A1 | 3/2012 | Dykstra |
| 2012/0061088 | A1 | 3/2012 | Dykstra et al. |
| 2012/0111577 | A1 | 5/2012 | Dykstra et al. |
| 2012/0125120 | A1 | 5/2012 | Dykstra |
| 2012/0125626 | A1 | 5/2012 | Constantine |
| 2012/0145385 | A1 | 6/2012 | Lopez |
| 2012/0168013 | A1 | 7/2012 | Schultz et al. |
| 2012/0168014 | A1 | 7/2012 | Schultz et al. |
| 2012/0168015 | A1 | 7/2012 | Schultz et al. |
| 2012/0181037 | A1 | 7/2012 | Holderman |
| 2012/0211243 | A1 | 8/2012 | Dykstra et al. |
| 2012/0227813 | A1 | 9/2012 | Meek et al. |
| 2012/0234557 | A1 | 9/2012 | Dykstra et al. |
| 2012/0255351 | A1 | 10/2012 | Dykstra |
| 2012/0255739 | A1 | 10/2012 | Fripp et al. |
| 2012/0255740 | A1 | 10/2012 | Fripp et al. |
| 2012/0292017 | A1 | 11/2012 | Schultz et al. |
| 2012/0292018 | A1 | 11/2012 | Schultz et al. |
| 2012/0292019 | A1 | 11/2012 | Schultz et al. |
| 2012/0292020 | A1 | 11/2012 | Schultz et al. |
| 2012/0292033 | A1 | 11/2012 | Schultz et al. |
| 2012/0292116 | A1 | 11/2012 | Schultz et al. |
| 2012/0305243 | A1 | 12/2012 | Hallundbaek et al. |
| 2013/0020088 | A1 | 1/2013 | Dyer et al. |
| 2013/0042699 | A1 | 2/2013 | Schultz et al. |
| 2013/0048274 | A1 | 2/2013 | Schultz et al. |
| 2013/0048299 | A1 | 2/2013 | Fripp et al. |
| 2013/0075081 | A1 | 3/2013 | Cavender et al. |
| 2013/0075107 | A1 | 3/2013 | Dykstra et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0118729 | A1 | 5/2013 | Greci |
| 2013/0153238 | A1 | 6/2013 | Fripp et al. |
| 2013/0180727 | A1 | 7/2013 | Dykstra et al. |
| 2013/0186633 | A1 | 7/2013 | Kitzman |
| 2013/0186634 | A1 | 7/2013 | Fripp et al. |
| 2013/0255960 | A1 | 10/2013 | Fripp et al. |
| 2013/0277066 | A1 | 10/2013 | Fripp et al. |
| 2013/0299198 | A1 | 11/2013 | Gano et al. |
| 2014/0041731 | A1 | 2/2014 | Fripp et al. |
| 2014/0048280 | A9 | 2/2014 | Fripp et al. |
| 2014/0048282 | A1 | 2/2014 | Dykstra et al. |

FOREIGN PATENT DOCUMENTS

| | | | |
|---|---|---|---|
| EP | 1857633 | A2 | 11/2007 |
| EP | 2146049 | A2 | 1/2010 |
| WO | 0214647 | A1 | 2/2002 |
| WO | 03062597 | A1 | 7/2003 |
| WO | 2004033063 | A2 | 4/2004 |
| WO | 2005093264 | A1 | 10/2005 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |
| WO | 2012033638 | A2 | 3/2012 |

OTHER PUBLICATIONS

Stanley W. Angrist; "Fluid Control Devices", published Dec. 1964, 5 pages.

U.S. Appl. No. 13/351,035, filed Jan. 16, 2012, 62 pages.

U.S. Appl. No. 13/359,617, filed Jan. 27, 2012, 42 pages.

U.S. Appl. No. 12/958,625, filed Dec. 2, 2010, 37 pages.

U.S. Appl. No. 12/974,212, filed Dec. 21, 2010, 41 pages.

Office Action issued Mar. 7, 2012 for U.S. Appl. No. 12/792,117, 40 pages.

Office Action issued Mar. 8, 2012 for U.S. Appl. No. 12/792,146, 26 pages.

U.S. Appl. No. 13/084,025, filed Apr. 11, 2011, 45 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

International Search Report with Written Opinion issued Apr. 17, 2012 for PCT Patent Application No. PCT/US11/050255, 9 pages.

International Search Report with Written Opinion issued Mar. 26, 2012 for PCT Patent Application No. PCT/US11/048986, 9 pages.

Office Action issued May 24, 2012 for U.S. Appl. No. 12/869,836, 60 pages.

Office Action issued May 24, 2012 for U.S. Appl. No. 13/430,507, 17 pages.

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Office Action issued Jun. 19, 2012 for U.S. Appl. No. 13/111,169, 17 pages.

Specification and Drawings for U.S. Appl. No. 13/495,078, filed Jun. 13, 2012, 39 pages.

(56) References Cited

OTHER PUBLICATIONS

Office Action issued Jun. 26, 2011 for U.S. Appl. No. 12/791,993, 17 pages.
Specification and Drawings for U.S. Appl. No. 12/792,095, filed Jun. 2, 2010, 29 pages.
Specification and Drawings for U.S. Appl. No. 10/650,186, filed Aug. 28, 2003, 16 pages.
Apparatus and Method of Inducing Fluidic Oscillation in a Rotating Cleaning Nozzle, ip.com, dated Apr. 24, 2007, 3 pages.
Office Action issued Jul. 25, 2012 for U.S. Appl. No. 12/881,296, 61 pages.
Specification and Drawings for U.S. Appl. No. 12/542,695, filed Aug. 18, 2009, 32 pages.
International Search Report with Written Opinion issued Aug. 3, 2012 for PCT Patent Application No. PCT/US11/059530, 15 pages.
International Search Report with Written Opinion issued Aug. 3, 2012 for PCT Patent Application No. PCT/US11/059534, 14 pages.
Office Action issued Oct. 26, 2011 for U.S. Appl. No. 13/111,169, 28 pages.
Office Action issued Nov. 2, 2011 for U.S. Appl. No. 12/792,146, 34 pages.
Office Action issued Nov. 3, 2011 for U.S. Appl. No. 13/111,169, 16 pages.
Office Action issued Nov. 2, 2011 for U.S. Appl. No. 12/792,117, 35 pages.
Office Action issued Oct. 27, 2011 for U.S. Appl. No. 12/791,993, 15 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31, 2002, 8 pages.
International Search Report with Written Opinion dated Aug. 31, 2012 for PCT Patent Application No. PCT/US11/060606, 10 pages.
Office Action issued Sep. 19, 2012 for U.S. Appl. No. 12/879,846, 78 pages.
Office Action issued Sep. 19, 2012 for U.S. Appl. No. 113/495,078, 29 pages.
Specification and Drawings for U.S. Appl. No. 13/659,323, filed Oct. 24, 2012, 81 pages.
Specification and Drawings for U.S. Appl. No. 13/659,375, filed Oct. 24, 2012, 54 pages.
Specification and Drawings for U.S. Appl. No. 13/659,435, filed Oct. 24, 2012, 37 pages.
Office Action issued Jan. 17, 2013 for U.S. Appl. No. 12/879,846, 26 pages.
Office Action issued Jan. 16, 2013 for U.S. Appl. No. 13/495,078, 24 pages.
Office Action issued Jan. 22, 2013 for U.S. Appl. No. 13/633,693, 30 pages.
Office Action issued Dec. 28, 2012 for U.S. Appl. No. 12/881,296, 29 pages.
Search Report and Written Opinion issued Oct. 19, 2012 for International Application No. PCT/US12/30641, 9 pages.
Office Action issued Oct. 16, 2012 for U.S. Appl. No. 12/983,153, 37 pages.
Advisory Action issued Aug. 30, 2012 for U.S. Appl. No. 13/111,169, 15 pages.
Office Action issued Apr. 23, 2013 for U.S. Appl. No. 13/659,323, 65 pages.
Office Action issued Apr. 24, 2013 for U.S. Appl. No. 13/633,693, 33 pages.
Office Action issued Apr. 26, 2013 for U.S. Appl. No. 13/678,489, 51 pages.
International Search Report with Written Opinion issued Feb. 28, 2013 for PCT Patent Application No. PCT/US12/050727, 12 pages.
Office Action issued Mar. 4, 2013 for U.S. Appl. No. 13/678,497, 26 pages.
Office Action issued Mar. 4, 2013 for U.S. Appl. No. 13/659,375, 24 pages.
Advisory Action issued Mar. 14, 2013 for U.S. Appl. No. 13/495,078, 14 pages.
Office Action issued Mar. 14, 2013 for U.S. Appl. No. 13/983,145, 23 pages.
Office Action issued Mar. 15, 2013 for U.S. Appl. No. 13/659,435, 20 pages.
Office Action issued Jun. 20, 2013 for U.S. Appl. No. 12/983,144, 60 pages.
Office Action issued Aug. 7, 2013 for U.S. Appl. No. 13/659,323, 37 pages.
Office Action issued Aug. 7, 2013 for U.S. Appl. No. 13/678,489, 24 pages.
International Preliminary Report on Patentability issued Jul. 11, 2013 for PCT Patent Application No. PCT/GB2011/001760, 7 pages.
Office Action issued Aug. 20, 2013 for U.S. Appl. No. 13/659,375, 24 pages.
Office Action issued Aug. 27, 2013 for U.S. Appl. No. 12/983,145, 29 pages.
International Search Report and Written Opinion issued May 2, 2013 for PCT Application No. PCT/GB2011/001758, 10 pages.
International Search Report and Written Opinion issued May 3, 2013 for PCT Application No. PCT/GB2011/001759, 10 pages.
Office Action issued May 16, 2013 for U.S. Appl. No. 13/213,259, 46 pages.
Office Action issued Jun. 4, 2013 for U.S. Appl. No. 12/983,150, 48 pages.
Office Action issued May 29, 2013 for U.S. Appl. No. 12/881,296, 26 pages.
Office Action issued Nov. 5, 2013 for U.S. Appl. No. 13/084,025, 23 pages.
Office Action issued Oct. 22, 2013 for U.S. Appl. No. 12/983,150, 31 pages.
Office Action issued Oct. 23, 2013 for U.S. Appl. No. 12/983,144, 38 pages.
Chinese Office Action issued Dec. 4, 2013 for Patent Application No. 201080034471.4, 7 pages.
Advisory Action issued Jan. 16, 2014 for U.S. Appl. No. 12/983,150, 3 pages.
Office Action issued Dec. 24, 2013 for U.S. Appl. No. 12/881,296, 30 pages.
Office Action issued Mar. 11, 2014 for U.S. Appl. No. 13/351,035, 120 pages.
Office Action issued Jun. 9, 2014 for U.S. Appl. No. 13/215,572, 44 pages.

* cited by examiner

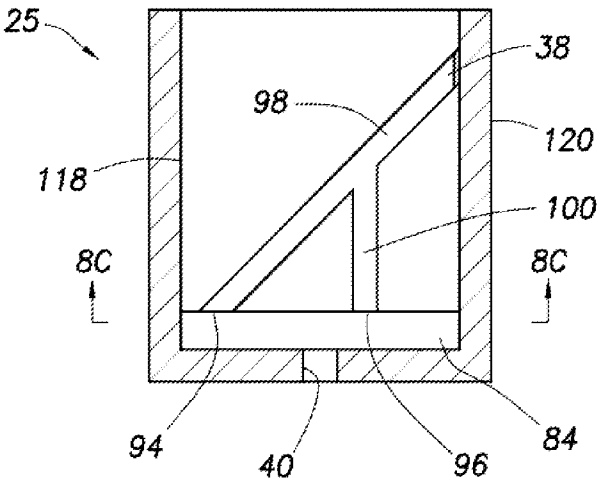
FIG.8B
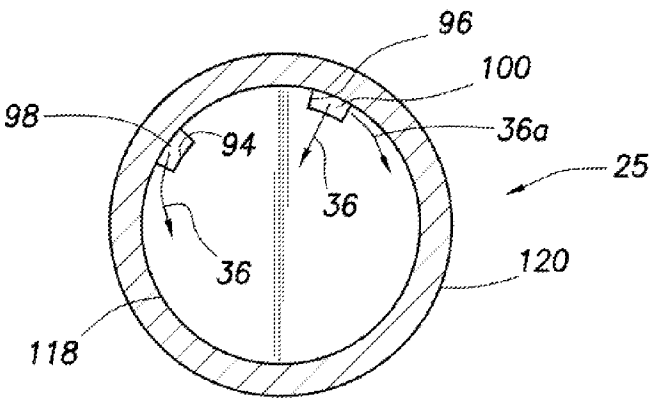
FIG.8C
FIG.8A
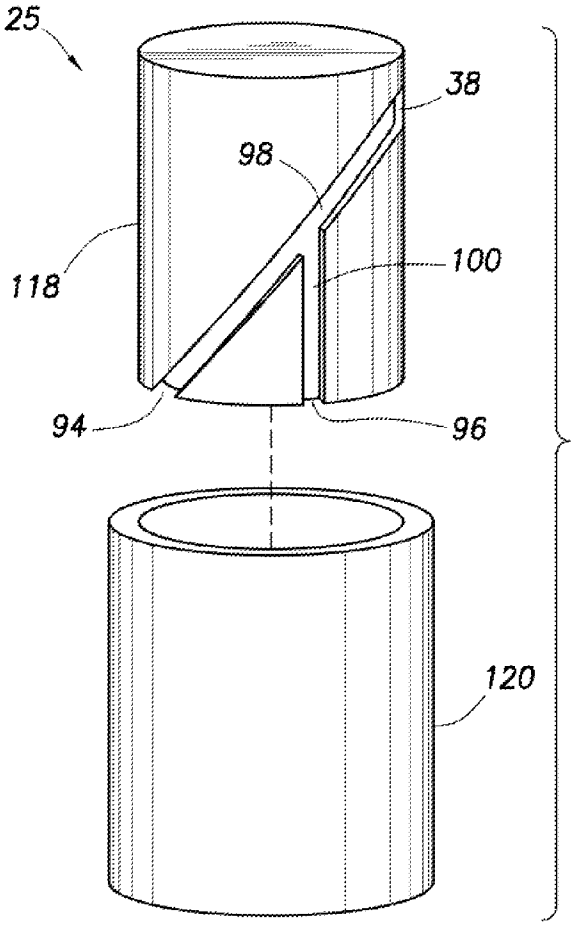

ALTERNATING FLOW RESISTANCE INCREASES AND DECREASES FOR PROPAGATING PRESSURE PULSES IN A SUBTERRANEAN WELL

CROSS-REFERENCE TO RELATED APPLICATIONS

This application is a continuation-in-part of prior application Ser. No. 12/700,685 filed on 4 Feb. 2010, which is a continuation-in-part of application Ser. No. 12/542,695 filed on 18 Aug. 2009. The entire disclosures of these prior applications are incorporated herein by this reference for all purposes.

BACKGROUND

This disclosure relates generally to equipment utilized and operations performed in conjunction with a subterranean well and, in an example described below, more particularly provides for propagating pressure pulses in a subterranean well.

In an injection well, hydrocarbon production well, or other type of well, it is many times beneficial to be able to propagate pressure pulses into a subterranean formation. Such pressure pulses can enhance mobility of fluids in the formation. For example, injected fluids can more readily flow into and spread through the formation in injection operations, and produced fluids can more readily flow from the formation into a wellbore in production operations.

Therefore, it will be appreciated that advancements in the art of propagating pressure pulses in a well would be desirable in the circumstances mentioned above, and such advancements would also be beneficial in a wide variety of other circumstances.

SUMMARY

In the disclosure below, a variable flow resistance system and associated methods are provided which bring improvements to the art of propagating pressure pulses in a well. An example is described below in which resistance to flow of a fluid composition is alternately increased and decreased as the fluid composition flows through a variable flow resistance system.

In one aspect, a method of propagating pressure pulses in a subterranean well is provided to the art by the present disclosure. The method can include flowing a fluid composition through at least one variable flow resistance system. The variable flow resistance system includes a vortex chamber having at least one inlet and an outlet. A vortex is created when the fluid composition flows spirally about the outlet. A resistance to flow of the fluid composition through the vortex chamber alternately increases and decreases.

In another aspect, the vortex is alternately created and dissipated in the vortex chamber, in response to flowing the fluid composition through the variable flow resistance system.

In yet another aspect, a subterranean well system can comprise at least one variable flow resistance system which propagates pressure pulses into a subterranean formation in response to flow of a fluid composition from the formation.

These and other features, advantages and benefits will become apparent to one of ordinary skill in the art upon careful consideration of the detailed description of representative examples below and the accompanying drawings, in which similar elements are indicated in the various figures using the same reference numbers.

BRIEF DESCRIPTION OF THE DRAWINGS

FIGS. 8A-C are schematic perspective, partially cross-sectional and cross-sectional views, respectively, of yet another configuration of the variable flow resistance system.

DETAILED DESCRIPTION

Figure 1:
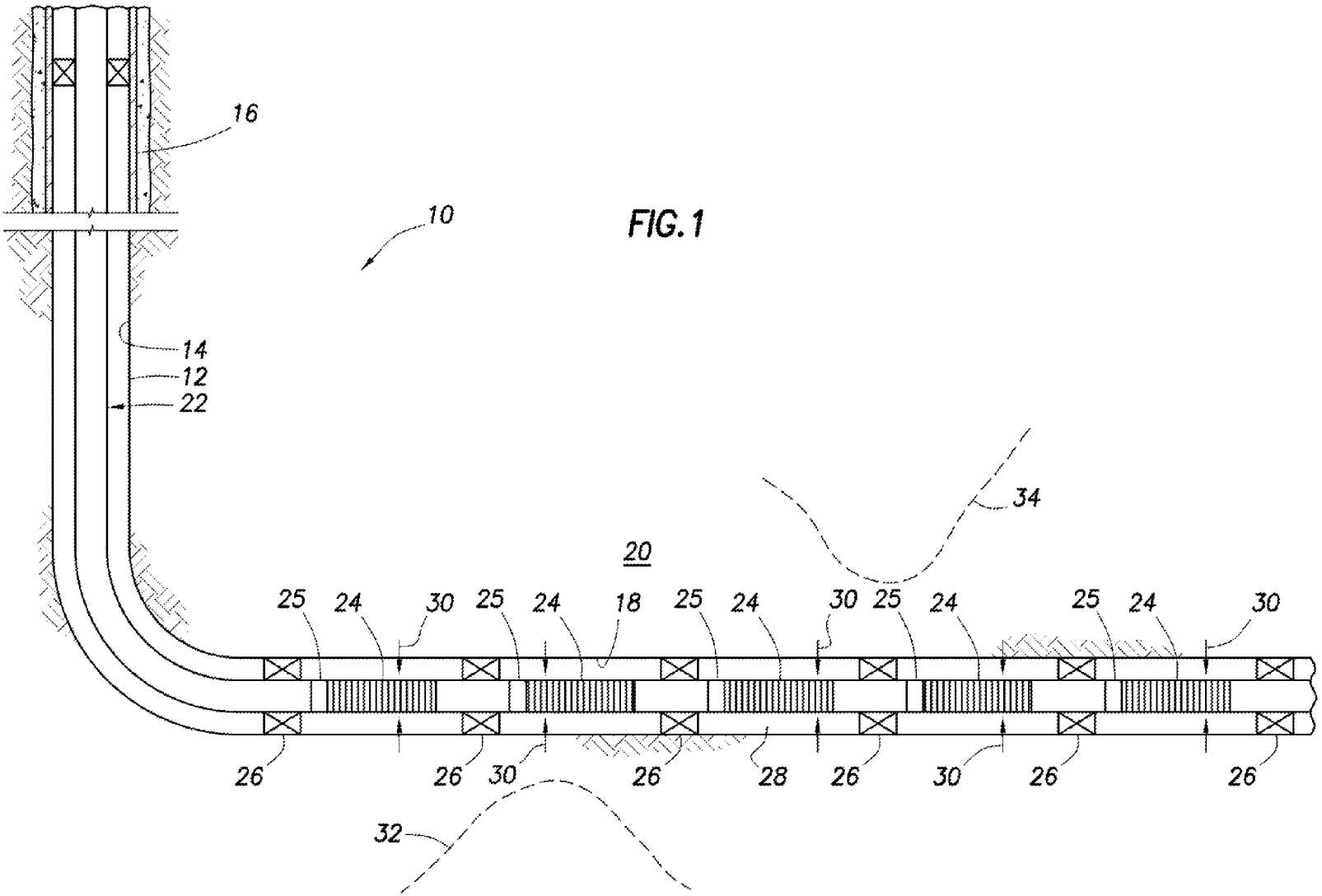
FIG. 1 is a schematic partially cross-sectional view of a well system and associated method which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, the principles of this disclosure can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), increasing resistance to flow if a fluid viscosity decreases below a selected level or if a fluid density increases above a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid in a fluid composition.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
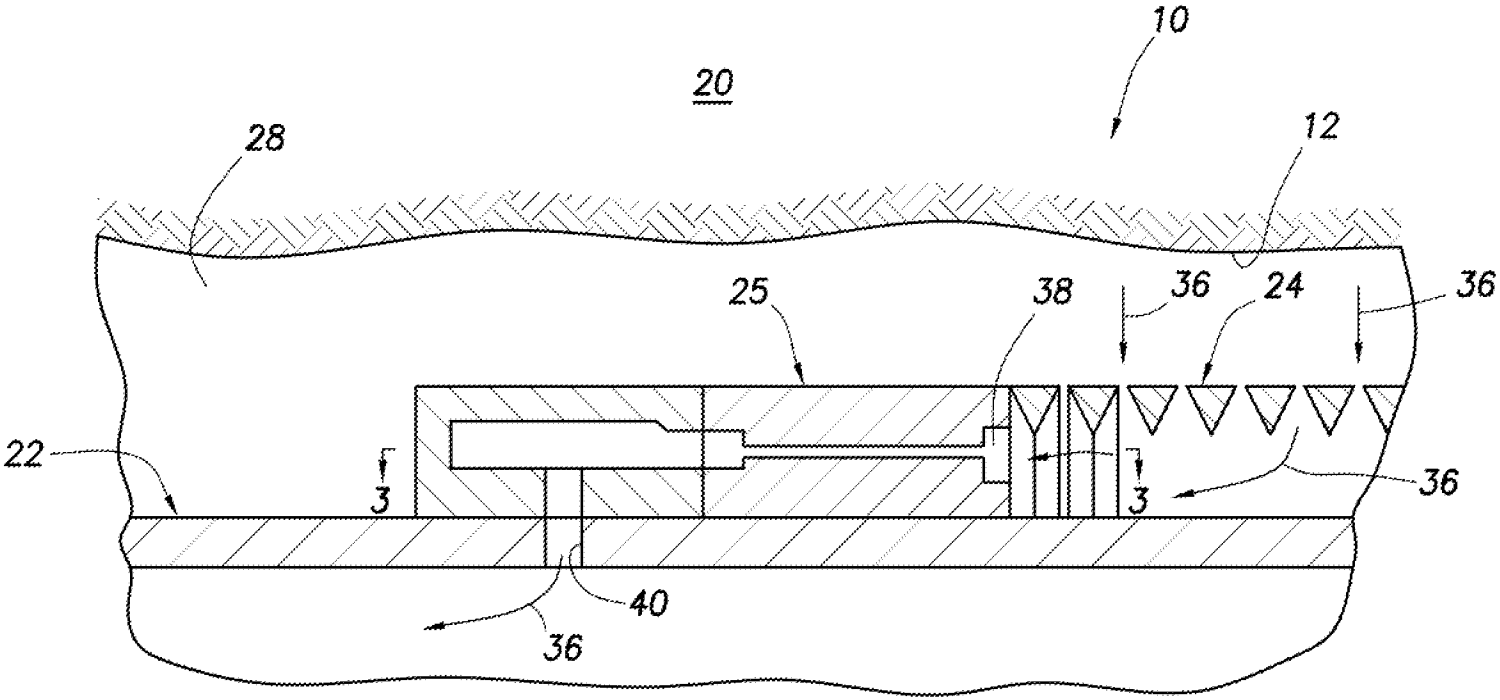
FIG. 2 is an enlarged scale schematic cross-sectional view of a well screen and a variable flow resistance system which may be used in the well system of FIG. 1.

Referring additionally now to FIG. 2, an enlarged cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as density, viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
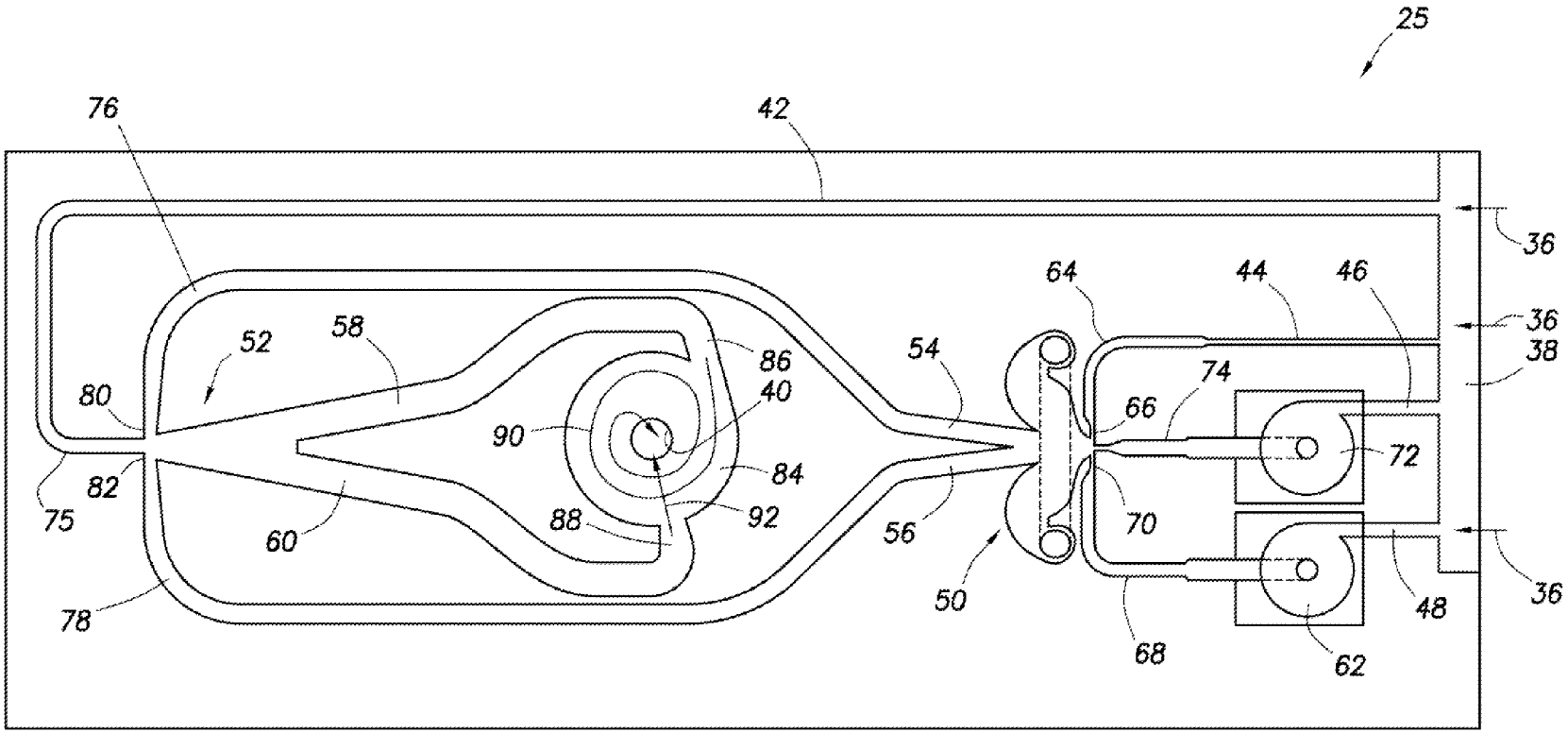
FIG. 3 is a schematic "unrolled" plan view of one configuration of the variable flow resistance system, taken along line 3-3 of FIG. 2.

Referring additionally now to FIG. 3, a more detailed cross-sectional view of one example of the system 25 is representatively illustrated. The system 25 is depicted in FIG. 3 as if it is "unrolled" from its circumferentially extending configuration to a generally planar configuration.

As described above, the fluid composition 36 enters the system 25 via the inlet 38, and exits the system via the outlet 40. A resistance to flow of the fluid composition 36 through the system 25 varies based on one or more characteristics of the fluid composition. The system 25 depicted in FIG. 3 is similar in most respects to that illustrated in FIG. 23 of the prior application Ser. No. 12/700,685 incorporated herein by reference above.

In the example of FIG. 3, the fluid composition 36 initially flows into multiple flow passages 42, 44, 46, 48. The flow passages 42, 44, 46, 48 direct the fluid composition 36 to two flow path selection devices 50, 52. The device 50 selects which of two flow paths 54, 56 a majority of the flow from the passages 44, 46, 48 will enter, and the other device 52 selects which of two flow paths 58, 60 a majority of the flow from the flow paths 54, 56 will enter.

The flow passage 44 is configured to be more restrictive to flow of fluids having higher viscosity. Flow of increased viscosity fluids will be increasingly restricted through the flow passage 44.

As used herein, the term "viscosity" is used to indicate any of the related rheological properties including kinematic viscosity, yield strength, viscoplasticity, surface tension, wettability, etc.

For example, the flow passage 44 may have a relatively small flow area, the flow passage may require the fluid flowing therethrough to follow a tortuous path, surface roughness or flow impeding structures may be used to provide an increased resistance to flow of higher viscosity fluid, etc. Relatively low viscosity fluid, however, can flow through the flow passage 44 with relatively low resistance to such flow.

A control passage 64 of the flow path selection device 50 receives the fluid which flows through the flow passage 44. A control port 66 at an end of the control passage 64 has a reduced flow area to thereby increase a velocity of the fluid exiting the control passage.

The flow passage 48 is configured to have a flow resistance which is relatively insensitive to viscosity of fluids flowing therethrough, but which may be increasingly resistant to flow of higher velocity or higher density fluids. Flow of increased viscosity fluids may be increasingly resisted through the flow passage 48, but not to as great an extent as flow of such fluids would be resisted through the flow passage 44.

In the example depicted in FIG. 3, fluid flowing through the flow passage 48 must flow through a "vortex" chamber 62 prior to being discharged into a control passage 68 of the flow path selection device 50. Since the chamber 62 in this example has a cylindrical shape with a central outlet, and the fluid composition 36 spirals about the chamber, increasing in velocity as it nears the outlet, driven by a pressure differential from the inlet to the outlet, the chamber is referred to as a "vortex" chamber. In other examples, one or more orifices, venturis, nozzles, etc. may be used.

The control passage 68 terminates at a control port 70. The control port 70 has a reduced flow area, in order to increase the velocity of the fluid exiting the control passage 68.

It will be appreciated that, as a viscosity of the fluid composition 36 increases, a greater proportion of the fluid composition will flow through the flow passage 48, control passage 68 and control port 70 (due to the flow passage 44 resisting flow of higher viscosity fluid more than the flow passage 48 and vortex chamber 62). Conversely, as a viscosity of the fluid composition 36 decreases, a greater proportion of the fluid composition will flow through the flow passage 44, control passage 64 and control port 66.

Fluid which flows through the flow passage 46 also flows through a vortex chamber 72, which may be similar to the vortex chamber 62 (although the vortex chamber 72 in a preferred example provides less resistance to flow therethrough than the vortex chamber 62), and is discharged into a central passage 74. The vortex chamber 72 is used for "impedance matching" to achieve a desired balance of flows through the flow passages 44, 46, 48.

Note that dimensions and other characteristics of the various components of the system 25 will need to be selected appropriately, so that desired outcomes are achieved. In the example of FIG. 3, one desired outcome of the flow path selection device 50 is that flow of a majority of the fluid composition 36 which flows through the flow passages 44, 46, 48 is directed into the flow path 54 when the fluid composition has a sufficiently high ratio of desired fluid to undesired fluid therein.

In this example, the desired fluid is oil, which has a higher viscosity than water or gas, and so when a sufficiently high proportion of the fluid composition 36 is oil, a majority (or at least a greater proportion) of the fluid composition 36 which enters the flow path selection device 50 will be directed to flow into the flow path 54, instead of into the flow path 56. This result is achieved due to the fluid exiting the control port 70 at a greater rate or at a higher velocity than fluid exiting the other control port 66, thereby influencing the fluid flowing from the passages 64, 68, 74 to flow more toward the flow path 54.

If the viscosity of the fluid composition 36 is not sufficiently high (and thus a ratio of desired fluid to undesired fluid is below a selected level), a majority (or at least a greater proportion) of the fluid composition which enters the flow path selection device 50 will be directed to flow into the flow path 56, instead of into the flow path 54. This will be due to the fluid exiting the control port 66 at a greater rate or at a higher velocity than fluid exiting the other control port 70, thereby influencing the fluid flowing from the passages 64, 68, 74 to flow more toward the flow path 56.

It will be appreciated that, by appropriately configuring the flow passages 44, 46, 48, control passages 64, 68, control ports 66, 70, vortex chambers 62, 72, etc., the ratio of desired to undesired fluid in the fluid composition 36 at which the device 50 selects either the flow passage 54 or 56 for flow of a majority of fluid from the device can be set to various different levels.

The flow paths 54, 56 direct fluid to respective control passages 76, 78 of the other flow path selection device 52. The control passages 76, 78 terminate at respective control ports 80, 82. A central passage 75 receives fluid from the flow passage 42.

The flow path selection device 52 operates similar to the flow path selection device 50, in that fluid which flows into the device 52 via the passages 75, 76, 78 is directed toward one of the flow paths 58, 60, and the flow path selection depends on a ratio of fluid discharged from the control ports 80, 82. If fluid flows through the control port 80 at a greater rate or velocity as compared to fluid flowing through the control port 82, then a majority (or at least a greater proportion) of the fluid composition 36 will be directed to flow through the flow path 60. If fluid flows through the control port 82 at a greater rate or velocity as compared to fluid flowing through the control port 80, then a majority (or at least a greater proportion) of the fluid composition 36 will be directed to flow through the flow path 58.

Although two of the flow path selection devices 50, 52 are depicted in the example of the system 25 in FIG. 3, it will be appreciated that any number (including one) of flow path selection devices may be used in keeping with the principles of this disclosure. The devices 50, 52 illustrated in FIG. 3 are of the type known to those skilled in the art as jet-type fluid ratio amplifiers, but other types of flow path selection devices (e.g., pressure-type fluid ratio amplifiers, bi-stable fluid switches, proportional fluid ratio amplifiers, etc.) may be used in keeping with the principles of this disclosure.

Fluid which flows through the flow path 58 enters a flow chamber 84 via an inlet 86 which directs the fluid to enter the chamber generally tangentially (e.g., the chamber 84 is shaped similar to a cylinder, and the inlet 86 is aligned with a tangent to a circumference of the cylinder). As a result, the fluid will spiral about the chamber 84, until it eventually exits via the outlet 40, as indicated schematically by arrow 90 in FIG. 3.

Fluid which flows through the flow path 60 enters the flow chamber 84 via an inlet 88 which directs the fluid to flow more directly toward the outlet 40 (e.g., in a radial direction, as indicated schematically by arrow 92 in FIG. 3). As will be readily appreciated, much less energy is consumed when the fluid flows more directly toward the outlet 40 as compared to when the fluid flows less directly toward the outlet.

Thus, less resistance to flow is experienced when the fluid composition 36 flows more directly toward the outlet 40 and, conversely, more resistance to flow is experienced when the fluid composition flows less directly toward the outlet. Accordingly, working upstream from the outlet 40, less resistance to flow is experienced when a majority of the fluid composition 36 flows into the chamber 84 from the inlet 88, and through the flow path 60.

A majority of the fluid composition 36 flows through the flow path 60 when fluid exits the control port 80 at a greater rate or velocity as compared to fluid exiting the control port 82. More fluid exits the control port 80 when a majority of the fluid flowing from the passages 64, 68, 74 flows through the flow path 54.

A majority of the fluid flowing from the passages 64, 68, 74 flows through the flow path 54 when fluid exits the control port 70 at a greater rate or velocity as compared to fluid exiting the control port 66. More fluid exits the control port 70 when a viscosity of the fluid composition 36 is above a selected level.

Thus, flow through the system 25 is resisted less when the fluid composition 36 has an increased viscosity (and a greater ratio of desired to undesired fluid therein). Flow through the system 25 is resisted more when the fluid composition 36 has a decreased viscosity.

More resistance to flow is experienced when the fluid composition 36 flows less directly toward the outlet 40 (e.g., as indicated by arrow 90). Thus, more resistance to flow is experienced when a majority of the fluid composition 36 flows into the chamber 84 from the inlet 86, and through the flow path 58.

A majority of the fluid composition 36 flows through the flow path 58 when fluid exits the control port 82 at a greater rate or velocity as compared to fluid exiting the control port 80. More fluid exits the control port 82 when a majority of the fluid flowing from the passages 64, 68, 74 flows through the flow path 56, instead of through the flow path 54.

A majority of the fluid flowing from the passages 64, 68, 74 flows through the flow path 56 when fluid exits the control port 66 at a greater rate or velocity as compared to fluid exiting the control port 70. More fluid exits the control port 66 when a viscosity of the fluid composition 36 is below a selected level.

As described above, the system 25 is configured to provide less resistance to flow when the fluid composition 36 has an increased viscosity, and more resistance to flow when the fluid composition has a decreased viscosity. This is beneficial when it is desired to flow more of a higher viscosity fluid, and less of a lower viscosity fluid (e.g., in order to produce more oil and less water or gas).

If it is desired to flow more of a lower viscosity fluid, and less of a higher viscosity fluid (e.g., in order to produce more gas and less water, or to inject more steam and less water), then the system 25 may be readily reconfigured for this purpose. For example, the inlets 86, 88 could conveniently be reversed, so that fluid which flows through the flow path 58 is directed to the inlet 88, and fluid which flows through the flow path 60 is directed to the inlet 86.

Although, as described above, a majority of the fluid composition 36 may enter the chamber 84 via the inlet 86, thereby having an increased resistance to flow, and in other circumstances a majority of the fluid composition may enter the chamber via the inlet 88, thereby having a reduced resistance to flow, the variable flow resistance system 25 can be configured so that the resistance to flow through the vortex chamber alternately increases and decreases. This can be accomplished in one example by the vortex 90 alternately being created and dissipated in the vortex chamber 84.

The variable flow resistance system 25 can be configured so that, when resistance to flow through the system is increased, a backpressure is transmitted through the system to the inlet 38 (and to elements upstream of the inlet), and a velocity of the fluid composition through the system is decreased. At such decreased velocity, proportionately more of the fluid composition 36 will flow through the flow passage 48, and a majority of the fluid composition which flows through the passages 66, 70, 74 will thus flow into the flow path 54.

When more of the fluid composition 36 flows through the control passage 76 to the control port 80, a majority of the fluid composition 36 will be influenced to flow through the flow path 60 to the inlet 88. Thus, the fluid composition 36 will flow more directly to the outlet 40 (as indicated by the arrow 92) and the resistance to flow through the system 25 will decrease. A previous vortex in the chamber 84 (indicated by vortex 90) will dissipate as the fluid composition 36 flows more directly to the outlet 40.

The decrease in resistance to flow through the system 25 results in a reduction of the backpressure transmitted through the system to the inlet 38 (and to elements upstream of the inlet), and the velocity of the fluid composition through the system is increased. At such increased velocity, proportionately more of the fluid composition 36 will flow through the flow passage 44, and a majority of the fluid composition which flows through the passage 66, 70, 74 will thus flow into the flow path 56.

When more of the fluid composition 36 flows through the control passage 78 to the control port 82, a majority of the fluid composition 36 will be influenced to flow through the flow path 58 to the inlet 86. Thus, the fluid composition 36 will flow more indirectly to the outlet 40 (as indicated by the vortex 90) and the resistance to flow through the system 25 will increase. The vortex 90 is created in the chamber 84 as the fluid composition 36 flows spirally about the outlet 40.

The flow resistance through the system 25 will alternately increase and decrease, causing the backpressure to alternately be increased and decreased in response. This backpressure can be useful, since in the well system 10 it will result in pressure pulses being propagated from the system 25 upstream into the annulus 28 and formation 20 surrounding the tubular string 22 and wellbore section 18.

Pressure pulses transmitted into the formation 20 can aid production of the fluids 30 from the formation, because the pressure pulses help to break down "skin effects" surrounding the wellbore 12, and otherwise enhance mobility of the fluids in the formation. By making it easier for the fluids 30 to flow from the formation 20 into the wellbore 12, the fluids can be more readily produced (e.g., the same fluid production rate will require less pressure differential from the formation to the wellbore, or more fluids can be produced at the same pressure differential, etc.).

The alternating increases and decreases in flow resistance through the system 25 can also cause pressure pulses to be transmitted downstream of the outlet 40. These pressure pulses downstream of the outlet 40 can be useful, for example, in circumstances in which the system 25 is used for injecting the fluid composition 36 into a formation.

In these situations, the injected fluid would be flowed through the system 25 from the inlet 38 to the outlet 40, and thence into the formation. The pressure pulses would be transmitted from the outlet 40 into the formation as the fluid composition 36 is flowed through the system 25 and into the formation. As with production operations, pressure pulses transmitted into the formation are useful in injection operations, because they enhance mobility of the injected fluids through the formation.

Other uses for the pressure pulses generated by the system 25 are possible, in keeping with the principles of this disclosure. In another example described more fully below, pressure pulses are used in a gravel packing operation to reduce voids and enhance consolidation of gravel in a gravel pack.

It will be appreciated that the system 25 obtains the benefits described above when fluid flows from the inlet 38 to the outlet 40 of the system. However, in some circumstances it may be desirable to generate pressure pulses both when fluid is flowed from the tubular string 22 into the formation 20 (e.g., in stimulation/injection operations), and when fluid is flowed from the formation into the tubular string (e.g., in production operations).

If it is desired to generate the pressure pulses both when fluid flows into the formation 20 and when fluid flows from the formation, multiple systems 25 can be used in parallel, with one or more of the systems being configured so that fluid flows from the inlet 38 to the outlet 40 when flowing the fluid into the formation, and with one or more of the other systems being configured so that fluid flows from the inlet to the outlet when flowing the fluid from the formation. Check valves or fluidic diodes could be used to prevent or highly restrict fluid from flowing to the inlet 38 from the outlet 40 in each of the systems 25.

Figure 4A:
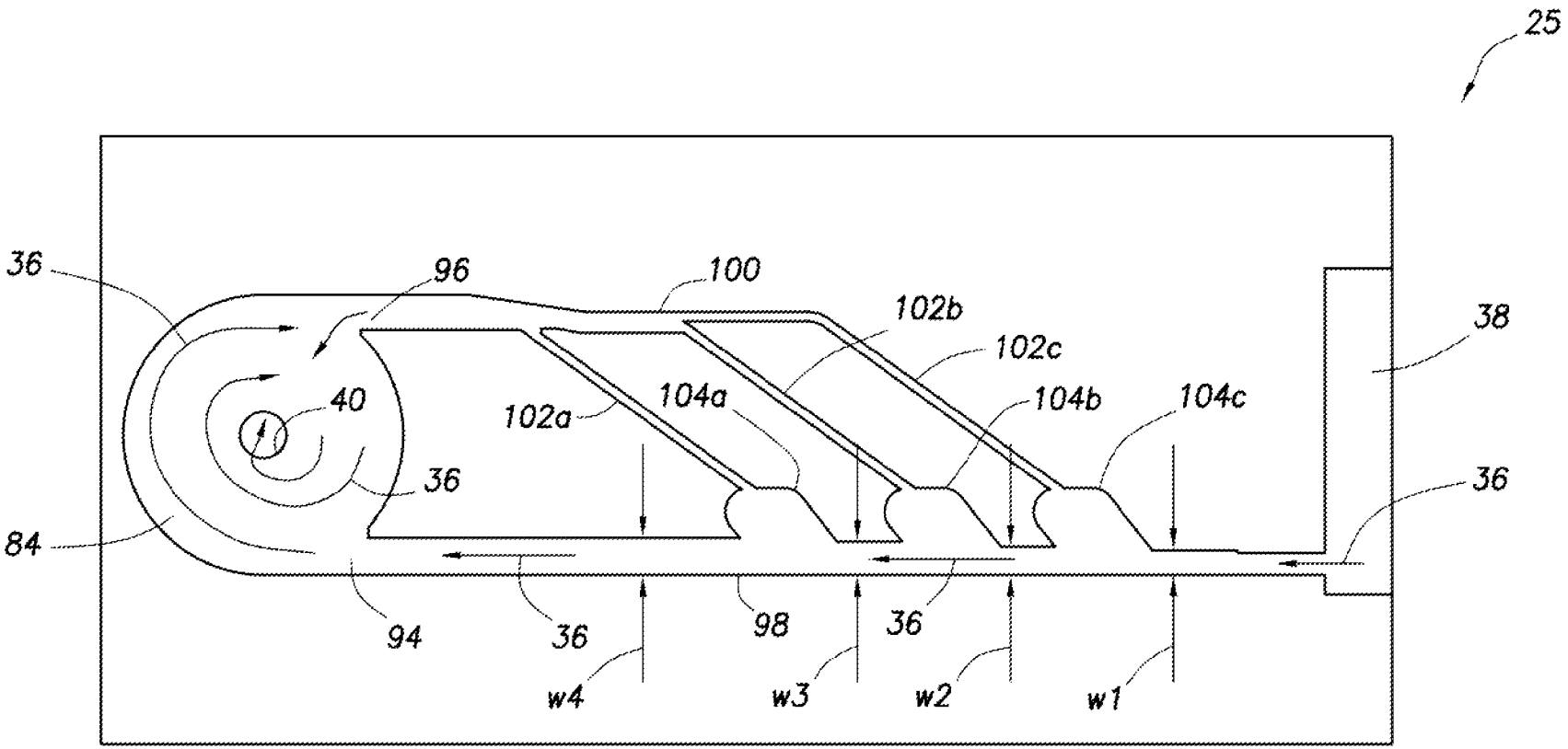
FIGS. 4A & B are schematic plan views of another configuration of the variable flow resistance system.

Referring additionally now to FIGS. 4A & B, another configuration of the variable flow resistance system 25 is representatively illustrated. The system 25 of FIGS. 4A & B is much less complex as compared to the system of FIG. 3, at least in part because it does not include the flow path selection devices 50, 52.

The vortex chamber 84 of FIGS. 4A & B is also somewhat different, in that two inlets 94, 96 to the chamber are supplied with flow of the fluid composition 36 via two flow passages 98, 100 which direct the fluid composition to flow in opposite directions about the outlet 40 (or at least in directions so that the flows from the inlets 94, 96 counteract each other). As depicted in FIGS. 4A & B, fluid which enters the chamber 84 via the inlet 94 is directed to flow in a clockwise direction (as viewed in FIGS. 4A & B) about the outlet 40, and fluid which enters the chamber via the inlet 96 is directed to flow in a counter-clockwise direction about the outlet.

In FIG. 4A, the system 25 is depicted in a situation in which an increased velocity of the fluid composition 36 results in a majority of the fluid composition flowing into the chamber 84 via the inlet 94. The fluid composition 36, thus spirals about the outlet 40 in the chamber 84, and a resistance to flow through the system 25 increases.

Relatively little of the fluid composition 36 flows into the chamber 84 via the inlet 96 in FIG. 4A, because the flow passage 100 is connected to branch passages 102*a-c* which branch from the flow passage 98 at eddy chambers 104*a-c*. At relatively high velocities, the fluid composition 36 tends to flow past the eddy chambers 104*a-c*, without a substantial amount of the fluid composition flowing through the eddy chambers and branch passages 102*a-c* to the flow passage 100.

This effect can be enhanced by increasing a width of the flow passage 98 at each eddy chamber 104*a-c* (e.g., as depicted in FIG. 4A, $w1<w2<w3<w4$). The volume of the eddy chambers 104*a-c* can also decrease in the downstream direction along the passage 98.

Figure 4B:
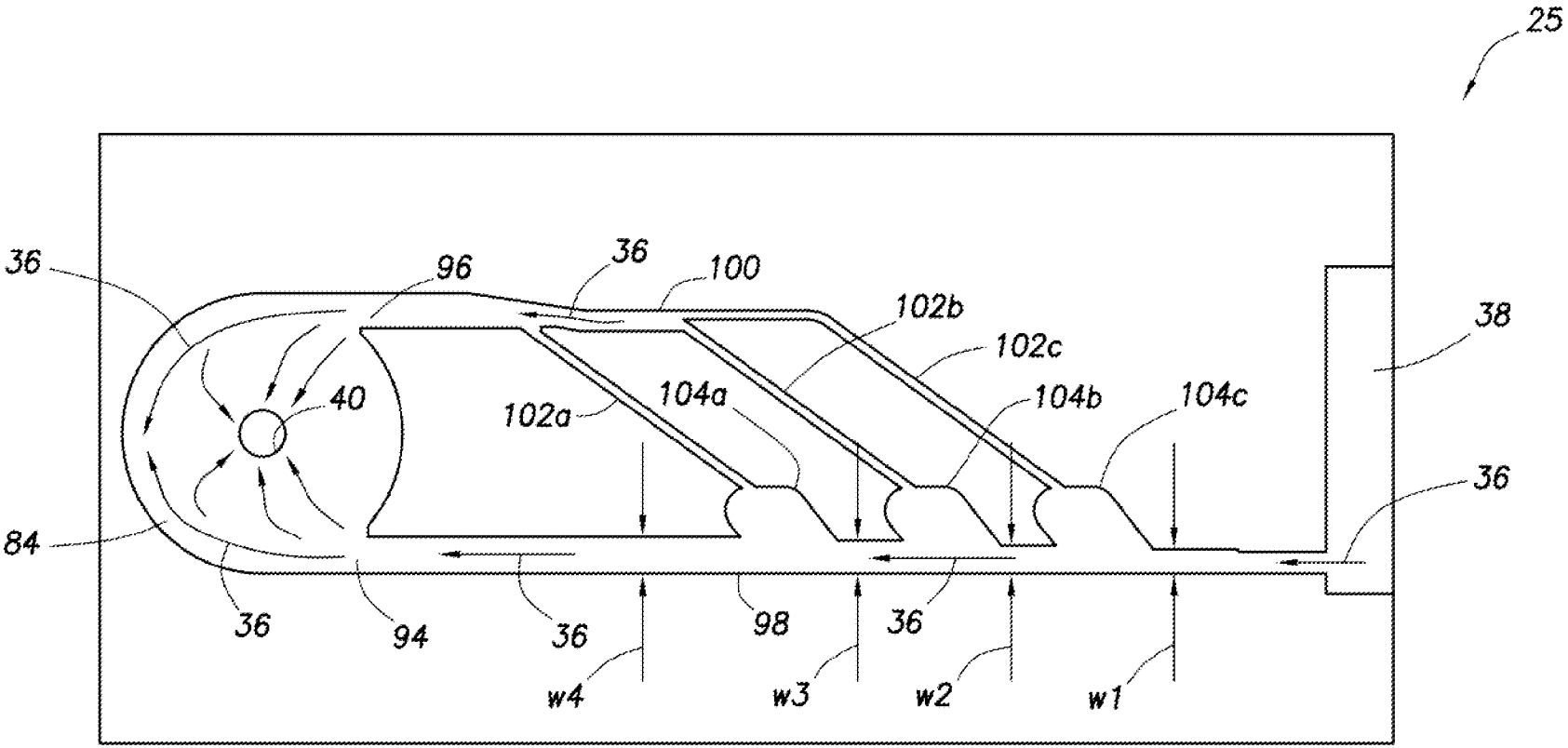

In FIG. 4B, a velocity of the fluid composition 36 has decreased (due to the increased flow restriction in FIG. 4A), and as a result, proportionately more of the fluid composition flows from the passage 98 into the branch passages 102*a-c* and via the passage 100 to the inlet 96. Since the flows into the chamber 84 from the two inlets 94, 96 are opposed to each other, they counteract each other, resulting in a disruption of the vortex 90 in the chamber.

As depicted in FIG. 4B, the fluid composition 36 flows less spirally about the outlet 40, and more directly to the outlet, thereby reducing the resistance to flow through the system 25. As a result, the velocity of the fluid composition 36 will increase, and the system 25 will return to the situation depicted in FIG. 4A.

It will be appreciated that the resistance to flow through the system 25 of FIGS. 4A & B will alternately increase and decrease as the fluid composition 36 flows through the system. A backpressure at the inlet 38 will alternately increase and decrease, resulting in pressure pulses being transmitted to elements upstream of the inlet.

Flow through the outlet 40 will also alternately increase and decrease, resulting in pressure pulses being transmitted to elements downstream of the outlet. A vortex 90 can be alternately created and dissipated in the chamber 84 as a result of the changing proportions of flow of the fluid composition 36 through the inlets 94, 96.

As with the system 25 of FIG. 3 described above, the system of FIGS. 4A & B can be configured so that the alternating increases and decreases in flow restriction through the system will occur when a characteristic of the fluid composition is within a predetermined range. For example, the alternating increases and decreases in flow restriction could occur when a viscosity, velocity, density and/or other characteristic of the fluid composition is within a desired range. As another example, the alternating increases and decreases in flow restriction could occur when a ratio of desired fluid to undesired fluid in the fluid composition is within a desired range.

In an oil production operation, it may be desired to transmit pressure pulses into the formation 20 when a large enough proportion of oil is being produced, in order to enhance the mobility of the oil through the formation. From another perspective, the system 25 could be configured so that the alternating increases and decreases in flow restriction occur when the viscosity of the fluid composition 36 is above a certain level (and so that the pressure pulses are not propagated into the formation 20 when an undesirably high proportion of water or gas is produced).

In an injection operation, it may be desired to transmit pressure pulses into the formation 20 when a large proportion of the injected fluid composition 36 is steam, rather than water. From another perspective, the system 25 could be configured so that the alternating increases and decreases in flow restriction occur when the density of the fluid composition 36 is below a certain level (and so that the pressure pulses are not propagated into the formation 20 when the fluid composition includes a relatively high proportion of water).

Thus, for a particular application, the vortex chamber(s), the various flow passages and other components of the system 25 are preferably designed so that the alternating increases and decreases in flow restriction through the system occur when the characteristics (e.g., density, viscosity, velocity, etc.) of the fluid composition 36 are as anticipated or desired. Some prototyping and testing will be required to establish how the various components of the system 25 should be designed to accomplish the particular objectives of a particular application, but undue experimentation will not be necessary if the principles of this disclosure are carefully considered by a person of ordinary skill in the art.

Figure 5A:
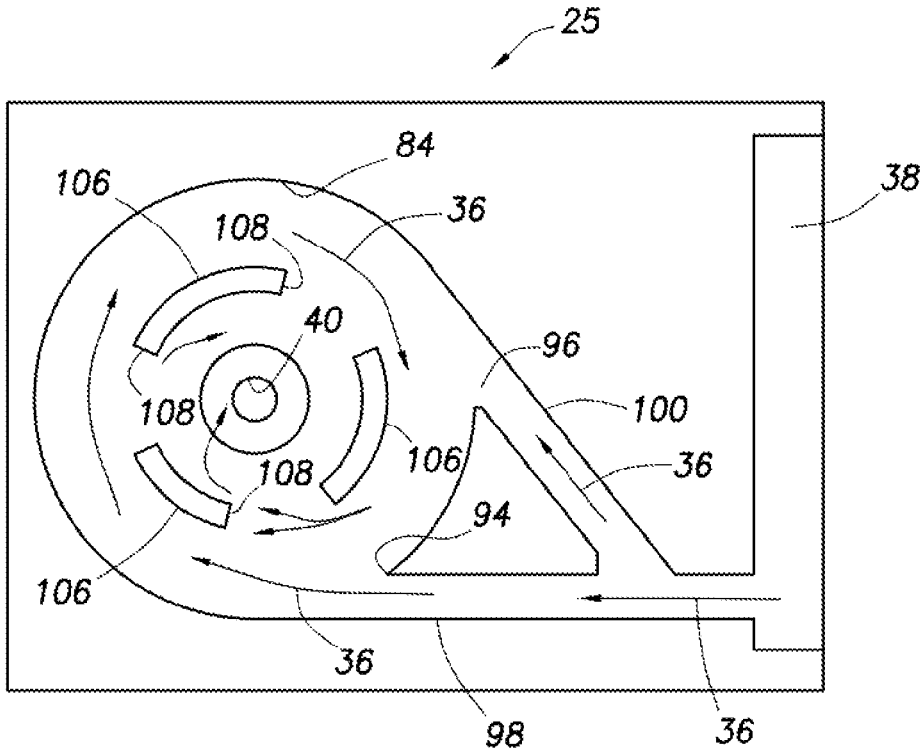
FIGS. 5A & B are schematic plan views of another configuration of the variable flow resistance system.

Referring additionally now to FIGS. 5A & B, another configuration of the variable flow resistance system 25 is representatively illustrated. The system 25 of FIGS. 5A & B is similar in many respects to the system of FIGS. 4A & B, but differs at least in that the branch passages 102*a-c* and eddy chambers 104*a-c* are not necessarily used in the FIGS. 5A & B configuration. Instead, the flow passage 100 itself branches off of the flow passage 98.

Another difference is that circular flow inducing structures 106 are used in the chamber 84 in the configuration of FIGS. 5A & B. The structures 106 operate to maintain circular flow of the fluid composition 36 about the outlet 40, or at least to impede inward flow of the fluid composition toward the outlet, when the fluid composition does flow circularly about the outlet. Openings 108 in the structures 106 permit the fluid composition 36 to eventually flow inward to the outlet 40.

The structures 106 are an example of how the configuration of the system 25 can be altered to produce the pressure pulses when they are desired (e.g., when the fluid composition 36 has a predetermined viscosity, velocity, density, ratio of desired to undesired fluid therein, etc.). The manner in which the flow passage 100 is branched off of the flow passage 98 is yet another example of how the configuration of the system 25 can be altered to produce the pressure pulses when they are desired.

In FIG. 5A, the system 25 is depicted in a situation in which an increased velocity of the fluid composition 36 results in a majority of the fluid composition flowing into the chamber 84 via the inlet 94. The fluid composition 36, thus, spirals about the outlet 40 in the chamber 84, and a resistance to flow through the system 25 increases.

Relatively little of the fluid composition 36 flows into the chamber 84 via the inlet 96 in FIG. 5A, because the flow passage 100 is branched from the flow passage 98 in a manner such that most of the fluid composition remains in the flow passage 98. At relatively high velocities, the fluid composition 36 tends to flow past the flow passage 100.

Figure 5B:
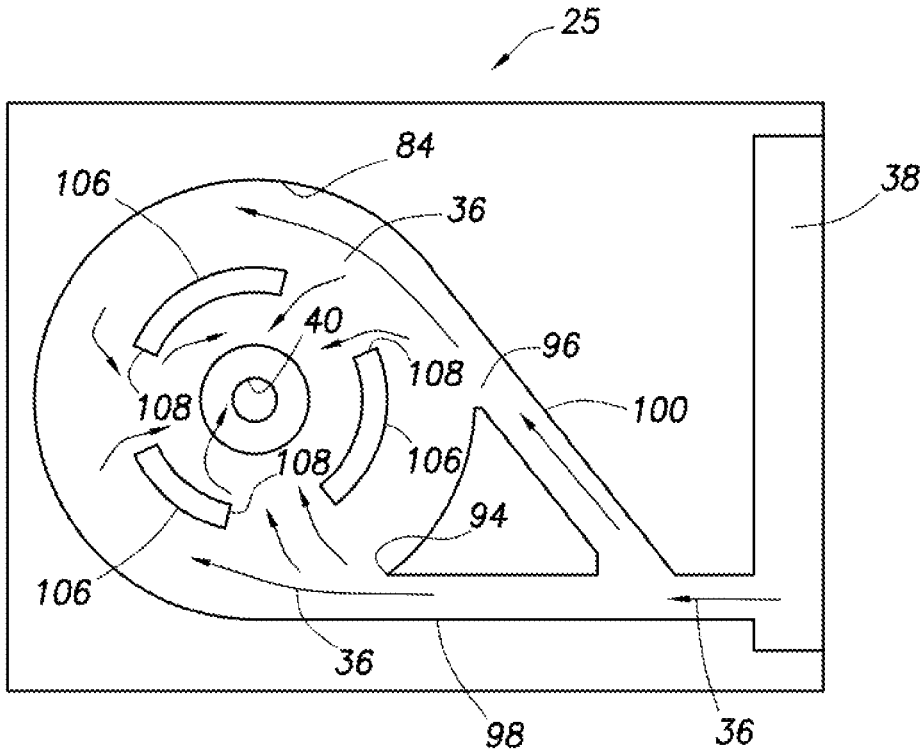

In FIG. 5B, a velocity of the fluid composition 36 has decreased (due to the increased flow restriction in FIG. 5A), and as a result, proportionately more of the fluid composition flows from the passage 98 and via the passage 100 to the inlet 96. Since the flows into the chamber 84 from the two inlets 94, 96 are oppositely directed (or at least the flow of the fluid composition through the inlet 96 opposes the flow through the inlet 94), they counteract each other, resulting in a disruption of the vortex 90 in the chamber.

As depicted in FIG. 5B, the fluid composition 36 flows less spirally about the outlet 40, and more directly to the outlet, thereby reducing the resistance to flow through the system 25. As a result, the velocity of the fluid composition 36 will increase, and the system 25 will return to the situation depicted in FIG. 5A.

It will be appreciated that the resistance to flow through the system 25 of FIGS. 5A & B will alternately increase and decrease as the fluid composition 36 flows through the system. A backpressure at the inlet 38 will alternately increase and decrease, resulting in pressure pulses being transmitted to elements upstream of the inlet.

Flow through the outlet 40 will also alternately increase and decrease, resulting in pressure pulses being transmitted to elements downstream of the outlet. A vortex 90 can be alternately created and dissipated in the chamber 84 as a result of the changing proportions of flow of the fluid composition 36 through the inlets 94, 96.

Figure 6:
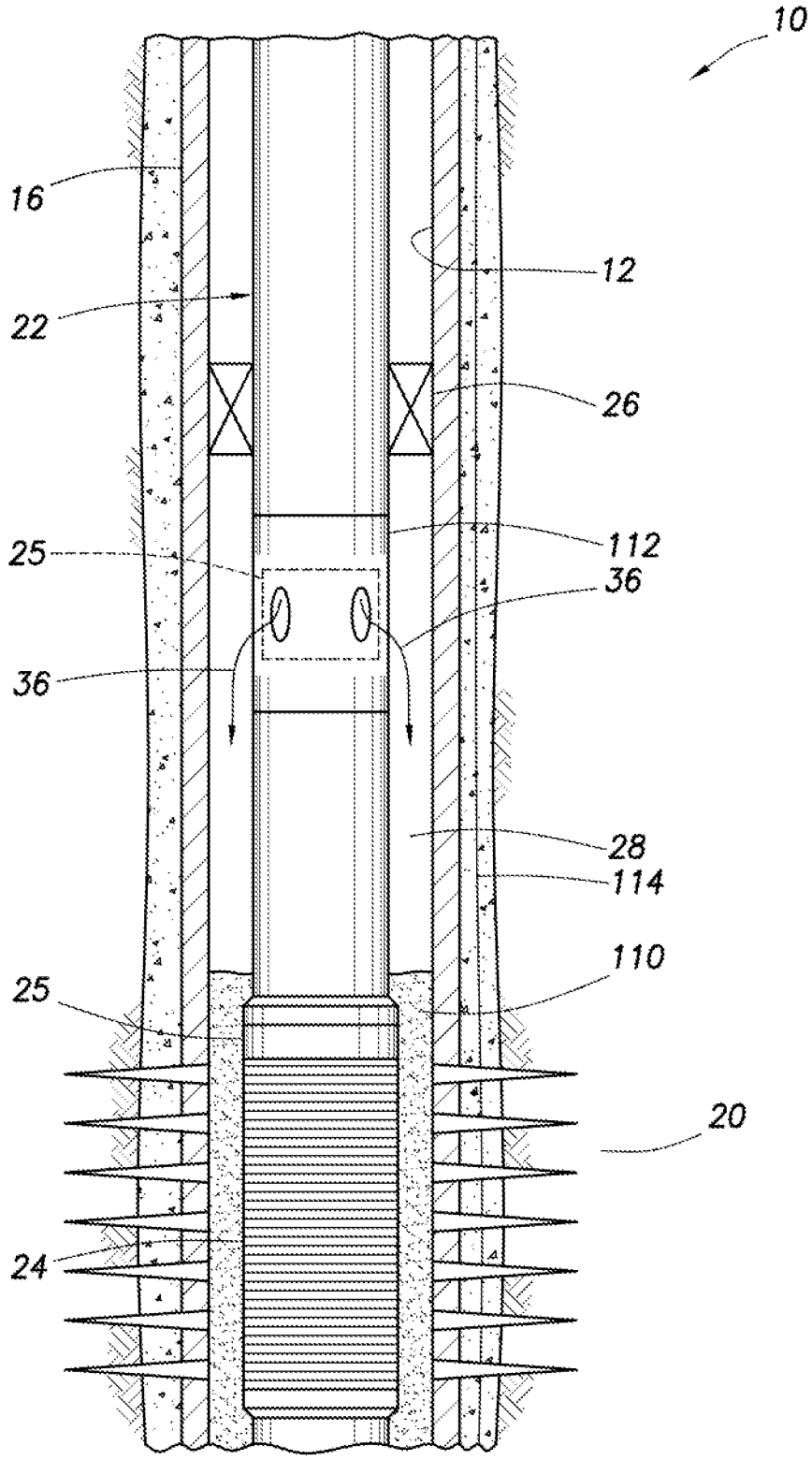
FIG. 6 is a schematic cross-sectional view of another configuration of the well system and method of FIG. 1.

Referring additionally now to FIG. 6, another configuration of the well system 10 is representatively illustrated. In this configuration, a gravel packing operation is being performed, in which the fluid composition 36 comprises a gravel slurry which is flowed out of the tubular string 22 and into the annulus 28 to thereby form a gravel pack 110 about one or more of the well screens 24.

In this gravel packing operation, the fluid portion of the gravel slurry (the fluid composition 36) flows inwardly through the well screen 24 and via the system 25 into the interior of the tubular string 22. Configured as described above, the system 25 preferably propagates pressure pulses into the gravel pack 110 as the gravel slurry is flowed into the annulus 28, thereby helping to eliminate voids in the gravel pack, helping to consolidate the gravel pack about the well screen 24, etc.

When production of fluids from the formation 20 is desired, the system 25 can propagate pressure pulses into the formation as fluid flows from the formation into the wellbore 12, and thence through the screen 24 and system 25 into the interior of the tubular string 22. Thus, the system 25 can beneficially propagate pressure pulses into the formation 20 during different well operations, although this is not necessary in keeping with the principles of this disclosure.

Alternatively, or in addition, another variable flow resistance system 25 may be incorporated into the tubular string 22 as part of a component 112 of the gravel packing equipment (such as a crossover or a slurry exit joint). The system 25 can, thus, alternately increase and decrease flow of the fluid composition 36 into the annulus 28, thereby propagating pressure pulses into the gravel pack 110, in response to flow of the fluid composition through the system.

A sensor 114 (such as a fiber optic acoustic sensor of the type described in U.S. Pat. No. 6,913,079, or another type of sensor) may be used to detect when the system 25 propagates the pressure pulses into the gravel pack 110, into the formation 20, etc. This may be useful in the well system 10 configuration of FIG. 6 in order to determine which of multiple gravel packs 110 is being properly placed, where along a long gravel pack appropriate flow is being obtained, etc. In the well system 10 configuration of FIG. 1, the sensor 114 may be used to determine where the fluids 30 are entering the tubular string 22 at an appropriate rate, etc.

Figure 7:
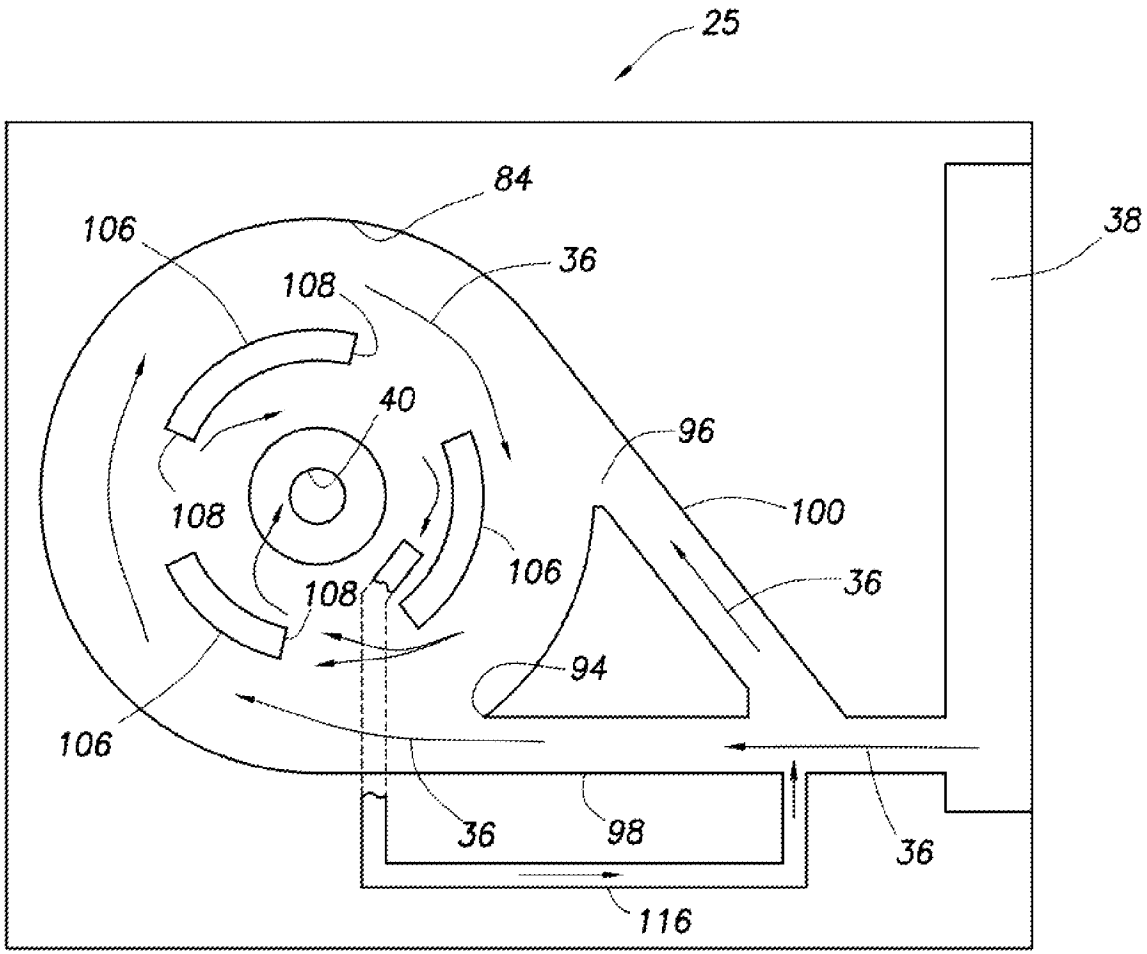
FIG. 7 is a schematic plan view of another configuration of the variable flow resistance system.

Referring additionally now to FIG. 7, another configuration of the variable flow resistance system 25 is representatively illustrated. The configuration of FIG. 7 is similar in most respects to the configuration of FIGS. 5A & B, but differs at least in that a control passage 116 is used in the configuration of FIG. 7 to deflect more of the fluid composition 36 toward the flow passage 100 when the fluid composition is spiraling about the chamber 84.

When a majority of the fluid composition 36 flows through the inlet 94 into the chamber 84, a momentum of the fluid composition spiraling about the outlet 40 can cause a relatively small portion of the fluid composition to enter the control passage 116. This portion of the fluid composition 36 will impinge upon the significantly larger portion of the fluid composition flowing through the passage 98, and will tend to divert more of the fluid composition to flow into the passage 100.

If the fluid composition 36 spirals more about the outlet 40, more of the fluid composition will enter the control passage 116, resulting in more of the fluid composition being diverted to the passage 100. If the fluid composition 36 does not spiral significantly about the outlet 40, little or no portion of the fluid composition will enter the control passage 116.

Thus, the control passage 116 can be used to adjust the velocity of the fluid composition 36 at which flow rates through the passages 98, 100 become more equal and resistance to flow through the system 25 is reduced. From another perspective, the control passage 116 can be used to adjust the velocity of the fluid composition 36 at which flow through the system 25 alternately increases and decreases to thereby propagate pressure pulses, and/or the control passage can be used to adjust the frequency of the pressure pulses.

Referring additionally now to FIGS. 8A-C, another configuration of the variable flow resistance system 25 is representatively illustrated. This configuration is similar in many respects to the system 25 of FIGS. 5A & B, in that the fluid composition 36 enters the chamber 84 via the passage 98, and a greater proportion of the fluid composition also enters the chamber via the passage 100 as the velocity of the fluid composition decreases, as the viscosity of the fluid composition increases, as the density of the fluid composition decreases and/or as a ratio of desired to undesired fluid in the fluid composition increases.

In the configuration of FIGS. 8A-C, the passages 98, 100 are formed on a generally cylindrical mandrel 118 which is received in a generally tubular housing 120, as depicted in FIG. 8A. The mandrel 118 may be, for example, shrink fit, press fit or otherwise secured tightly and/or sealingly within the housing 120.

As seen in FIG. 8B, the chamber 84 is formed axially between an end of the mandrel and an inner end of the housing 120. The outlet 40 extends through an end of the housing 120.

Each of the passages 98, 100 is in fluid communication with the chamber 84. However, flow of the fluid composition 36 which enters the chamber 84 via the inlet 94 will flow circularly within the chamber, and flow of the fluid composition which enters the chamber via the inlet 96 will flow more directly toward the outlet 40, as depicted in FIG. 8C.

In another example, the inlet 96 could be configured to direct the flow of the fluid composition 36 in a direction which opposes that of the fluid composition which enters the chamber via the inlet 94 (as indicated by fluid composition 36*a* in FIG. 8C), so that the flows counteract each other as described above for the configuration of FIGS. 5A & B. The chamber 84 may also be provided with the structures 106, openings 108 and control passage 116 as described above, if desired.

It may now be fully appreciated that the above disclosure provides several advancements to the art of propagating pressure pulses in a well. The variable flow resistance system 25 can generate pressure pulses due to alternating increases and decreases in flow resistance through the system, alternating creation and dissipation of a vortex in the vortex chamber 84, etc., and can be configured to do so when a characteristic of a fluid composition 36 flowed through the system is within a predetermined range.

The above disclosure provides to the art a method of propagating pressure pulses in a subterranean well. The method can comprise flowing a fluid composition 36 through at least one variable flow resistance system 25 which includes a vortex chamber 84 having at least one inlet 86, 88, 94, 96 and an outlet 40. A vortex 90 is created when the fluid composition 36 flows spirally about the outlet 40. A resistance to flow of the fluid composition 36 through the vortex chamber 84 alternately increases and decreases.

The vortex 90 may be alternately created and dissipated in response to flowing the fluid composition 36 through the variable flow resistance system 25.

The pressure pulses can be propagated upstream and/or downstream from the variable flow resistance system 25 when the flow resistance alternately increases and decreases. The pressure pulses may be propagated from the variable flow resistance system 25 into a subterranean formation 20 when the flow resistance alternately increases and decreases.

The pressure pulses may be propagated through a gravel pack 110 when the flow resistance alternately increases and decreases.

The step of flowing the fluid composition 36 can further include flowing the fluid composition 36 from a subterranean formation 20 into a wellbore 12. The step of flowing the fluid composition 36 can further include flowing the fluid composition 36 from the wellbore 12 into a tubular string 22 via the variable flow resistance system 25.

The flow resistance may alternately increase and decrease when a characteristic of the fluid composition 36 is within a predetermined range. The characteristic can comprise a viscosity, velocity, density and/or ratio of desired to undesired fluid in the fluid composition 36. The flow resistance may alternately increase and decrease only when the characteristic of the fluid composition 36 is within the predetermined range.

The step of flowing the fluid composition 36 through the variable flow resistance system 25 can include flowing multiple fluid compositions 36 through respective multiple variable flow resistance systems 25. The method can include the step of detecting which of the variable flow resistance systems 25 have flow resistances which alternately increase and decrease in response to flow of the respective fluid composition 36.

Also described above is a subterranean well system 10 which can include at least one variable flow resistance system 25 which propagates pressure pulses into a subterranean formation 20 in response to flow of a fluid composition 36 from the formation 20.

The well system 10 may also include a tubular string 22 positioned in a wellbore 12 intersecting the subterranean formation 20. The variable flow resistance system 25 can propagate the pressure pulses into the formation 20 in response to flow of the fluid composition 36 from the formation 20 and into the tubular string 22.

The variable flow resistance system 25 may include a vortex chamber 84 having at least one inlet 86, 88, 94, 96 and an outlet 40. A vortex 90 may be created when the fluid composition 36 flows spirally about the outlet 40.

The vortex 90 may be alternately created and dissipated in response to flow of the fluid composition 36 through the variable flow resistance system 25.

The above disclosure also describes a variable flow resistance system 25 for use in a subterranean well, with the variable flow resistance system 25 comprising a vortex chamber 84 having an outlet 40, and at least first and second inlets 94, 96. The first inlet 94 may direct a fluid composition 36 to flow in a first direction, and the second inlet 96 may direct the fluid composition 36 to flow in a second direction, so that any of the fluid composition flowing in the first direction opposes any of the fluid composition flowing in the second direction.

A resistance to flow of the fluid composition 36 through the vortex chamber 84 may decrease as flow through the first and second inlets 94, 96 becomes more equal. Flow through the first and second inlets 94, 96 may become more equal as a viscosity of the fluid composition 36 increases, as a velocity of the fluid composition 36 decreases, as a density of the fluid composition 36 decreases, and/or as a ratio of desired fluid to undesired fluid in the fluid composition 36 increases.

A resistance to flow of the fluid composition 36 through the vortex chamber 84 may increase as flow through the first and second inlets 94, 96 becomes less equal.

The fluid composition 36 may flow to the first inlet 94 via a first flow passage 98 which is oriented generally tangential to the vortex chamber 84. The fluid composition 36 may flow to the second inlet 96 via a second flow passage 100 which is oriented generally tangential to the vortex chamber 84, and the second passage 100 may receive the fluid composition 36 from a branch of the first flow passage 98.

Also described above is a method of propagating pressure pulses in a subterranean well, which method can include the steps of flowing a fluid composition 36 through at least one variable flow resistance system 25 which includes a vortex chamber 84 having at least one inlet 86, 88, 94, 96 and an outlet 40, a vortex 90 being created when the fluid composition 36 flows spirally about the outlet 40; and the vortex 90 being alternately created and dissipated in response to the step of flowing the fluid composition 36 through the variable flow resistance system 25.

A resistance to flow of the fluid composition 36 through the vortex chamber 84 may alternately increase and decrease when the vortex 90 is alternately created and dissipated.

The pressure pulses may be propagated upstream and/or downstream from the variable flow resistance system 25 when the vortex 90 is alternately created and dissipated.

The pressure pulses may be propagated from the variable flow resistance system 25 into a subterranean formation 20 when the vortex 90 is alternately created and dissipated.

The pressure pulses may be propagated through a gravel pack 110 when the vortex 90 is alternately created and dissipated.

The vortex 90 may be alternately created and dissipated when a characteristic of the fluid composition 36 is within a predetermined range. The characteristic may comprises a viscosity, velocity, density and/or a ratio of desired to undesired fluid in the fluid composition 36.

The vortex 90 may be alternately created and dissipated only when the characteristic of the fluid composition 36 is within the predetermined range.

The at least one inlet can comprise first and second inlets 94, 96. The variable flow resistance system 25 can further include a control passage 110 which receives a portion of the fluid composition 36 from the vortex chamber 84, thereby influencing more of the fluid composition 36 to flow into the chamber 84 via the second inlet 96, when the fluid composition 36 spirals about the outlet 40 in the chamber 84 due to flow of the fluid composition 36 into the chamber 84 via the first inlet 94.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of propagating pressure pulses in a subterranean well, the method comprising:

flowing a fluid composition through at least one variable flow resistance system which includes an inlet, a vortex chamber, and an outlet, a vortex being created when the fluid composition flows spirally about the outlet; and the vortex being alternately created and dissipated in response to a variation in backpressure being transmitted from the vortex chamber to the inlet, wherein the inlet supplies the fluid composition to first and second flow passages, and wherein the variable flow resistance system further comprises a control passage which receives a portion of the fluid composition from the vortex chamber, thereby influencing more of the fluid composition to flow into the chamber via the second flow passage, when the fluid composition spirals about the outlet in the chamber due to flow of the fluid composition into the chamber via the first flow passage.

2. The method of claim 1, wherein a resistance to flow of the fluid composition through the vortex chamber alternately increases and decreases when the vortex is alternately created and dissipated.

3. The method of claim 1, wherein the pressure pulses are propagated upstream from the variable flow resistance system when the vortex is alternately created and dissipated.

4. The method of claim 1, wherein the pressure pulses are propagated downstream from the variable flow resistance system when the vortex is alternately created and dissipated.

5. The method of claim 1, wherein the pressure pulses are propagated from the variable flow resistance system into a subterranean formation when the vortex is alternately created and dissipated.

6. The method of claim 1, wherein the pressure pulses are propagated through a gravel pack when the vortex is alternately created and dissipated.

7. The method of claim 1, wherein the flowing the fluid composition further comprises flowing the fluid composition from a subterranean formation into a wellbore.

8. The method of claim 7, wherein the flowing the fluid composition further comprises flowing the fluid composition from the wellbore into a tubular string via the variable flow resistance system.

9. The method of claim 1, wherein the vortex is alternately created and dissipated when a characteristic of the fluid composition is within a predetermined range.

10. The method of claim 9, wherein the characteristic comprises a viscosity of the fluid composition.

11. The method of claim 9, wherein the characteristic comprises a velocity of the fluid composition.

12. The method of claim 9, wherein the characteristic comprises a density of the fluid composition.

13. The method of claim 9, wherein the vortex is alternately created and dissipated only when the characteristic of the fluid composition is within the predetermined range.

14. The method of claim 1, wherein the vortex is alternately created and dissipated when a ratio of desired to undesired fluid in the fluid composition is within a predetermined range.

15. A method of propagating pressure pulses in a subterranean well, the method comprising:

flowing a fluid composition through at least one variable flow resistance system which includes an inlet, a vortex chamber, and an outlet, a vortex being created when the fluid composition flows spirally about the outlet, wherein the flowing further comprises flowing multiple fluid compositions through respective multiple variable flow resistance systems;

the vortex being alternately created and dissipated in response to a variation in backpressure being transmitted from the vortex chamber to the inlet; and detecting which of the variable flow resistance systems have vortices which are alternately created and dissipated in response to flow of the respective fluid composition.

* * * * *